US009236679B2

(12) United States Patent
Beckstedt et al.

(10) Patent No.: US 9,236,679 B2
(45) Date of Patent: Jan. 12, 2016

(54) ELECTRIC COUPLING ELEMENT

(71) Applicant: Harting Electric GmbH & Co. KG, Espelkamp (DE)

(72) Inventors: Alexej Beckstedt, Lotte-Wersen (DE); Andreas Rueter, Rahden (DE); Heiko Meier, Minden (DE)

(73) Assignee: HARTING ELECTRIC GMBH & CO. KG, Espelkamp (DE)

( * ) Notice: Subject to any disclaimer, the term of this patent is extended or adjusted under 35 U.S.C. 154(b) by 0 days.

(21) Appl. No.: 14/375,921

(22) PCT Filed: Nov. 23, 2012

(86) PCT No.: PCT/DE2012/100357

§ 371 (c)(1),
(2) Date: Jul. 31, 2014

(87) PCT Pub. No.: WO2013/113301

PCT Pub. Date: Aug. 8, 2013

(65) Prior Publication Data

US 2014/0370731 A1 Dec. 18, 2014

(30) Foreign Application Priority Data

Feb. 1, 2012 (DE) ..... 10 2012 100 815

(51) Int. Cl.

| | |
|---|---|
| ***H01R 13/447*** | (2006.01) |
| ***H01R 4/36*** | (2006.01) |
| ***H01R 9/24*** | (2006.01) |
| ***H01R 13/502*** | (2006.01) |
| ***H01R 13/514*** | (2006.01) |
| ***H01R 13/518*** | (2006.01) |

(52) U.S. Cl.

CPC ..... *H01R 13/447* (2013.01); *H01R 4/36* (2013.01); *H01R 9/2408* (2013.01); *H01R 13/502* (2013.01); *H01R 13/514* (2013.01); *H01R 13/518* (2013.01)

(58) Field of Classification Search

CPC ..... H01R 13/4364; H01R 13/4365; H01R 13/4367; H01R 13/4368

See application file for complete search history.

(56) References Cited

U.S. PATENT DOCUMENTS

| | | | | | |
|---|---|---|---|---|---|
| 4,243,288 | A | * | 1/1981 | Lucius et al. | 439/399 |
| 4,413,872 | A | * | 11/1983 | Rudy et al. | 439/467 |
| 4,435,035 | A | * | 3/1984 | Berry et al. | 439/404 |
| 5,100,345 | A | * | 3/1992 | Endo et al. | 439/595 |
| 5,122,077 | A | * | 6/1992 | Maejima et al. | 439/398 |
| 5,320,555 | A | * | 6/1994 | Okabe | 439/354 |

(Continued)

FOREIGN PATENT DOCUMENTS

| | | |
|---|---|---|
| DE | 3442056 | 5/1986 |
| DE | 4311781 | 6/1994 |

(Continued)

*Primary Examiner* — Ross Gushi

(74) *Attorney, Agent, or Firm* — Jacobson Holman, PLLC.

(57) ABSTRACT

The invention relates to an electric coupling element (1). Pin or socket contact elements (20), with which an electric means of a screwable connection means (28), are arranged in an electrically insulating main part (10). Openings (18) in the main part (10) are covered by means of a covering panel (30) I order to ensure the electric insulation of the individual contact elements (20). For assembly purposes, the covering panel (30) is movably attached to the main part (10) such that the covering panels (30, 30') of two coupling elements (1, 1') are mutually actuated when joined together.

8 Claims, 4 Drawing Sheets

(56) References Cited

U.S. PATENT DOCUMENTS

| | | | | | |
|---|---|---|---|---|---|
| 5,683,272 | A * | 11/1997 | Abe | 439/747 |
| 5,697,819 | A * | 12/1997 | Hatagishi | 439/752 |
| 5,700,163 | A * | 12/1997 | Okabe | 439/596 |
| 5,713,756 | A * | 2/1998 | Abe | 439/404 |
| 5,779,506 | A * | 7/1998 | Okabe et al. | 439/752 |
| 5,803,773 | A * | 9/1998 | Kashiyama et al. | 439/752 |
| 5,888,103 | A * | 3/1999 | Norizuki et al. | 439/701 |
| 5,890,933 | A * | 4/1999 | Okabe | 439/701 |
| 5,895,285 | A * | 4/1999 | Okabe | 439/400 |
| 5,934,944 | A * | 8/1999 | Aoyama et al. | 439/701 |
| 5,967,843 | A * | 10/1999 | Okabe et al. | 439/596 |
| 6,000,967 | A * | 12/1999 | Norizuki et al. | 439/596 |
| 6,000,971 | A * | 12/1999 | Hatagishi et al. | 439/701 |
| 6,004,162 | A | 12/1999 | Harting et al. | |
| 6,027,374 | A * | 2/2000 | Nagai et al. | 439/596 |
| 6,045,409 | A * | 4/2000 | Abe | 439/701 |
| 6,083,056 | A * | 7/2000 | Okabe et al. | 439/701 |
| 6,113,437 | A * | 9/2000 | Abe | 439/701 |
| 6,135,824 | A * | 10/2000 | Okabe et al. | 439/701 |
| 6,165,012 | A * | 12/2000 | Abe et al. | 439/596 |
| 6,176,740 | B1 * | 1/2001 | Abe et al. | 439/596 |
| 6,224,416 | B1 * | 5/2001 | Nagai | 439/400 |
| 6,231,400 | B1 * | 5/2001 | Nagai | 439/701 |
| 6,280,262 | B1 * | 8/2001 | Tanaka | 439/752 |
| 6,296,530 | B1 * | 10/2001 | Yoneda et al. | 439/701 |
| 6,299,471 | B1 * | 10/2001 | Hatagishi et al. | 439/397 |
| 6,319,071 | B1 * | 11/2001 | Sato | 439/701 |
| 6,319,074 | B1 * | 11/2001 | Kashiyama | 439/752 |
| 6,336,831 | B1 * | 1/2002 | Abe | 439/701 |
| 6,343,960 | B1 * | 2/2002 | Sato | 439/701 |
| 6,354,887 | B2 * | 3/2002 | Maeda | 439/701 |
| 6,402,568 | B1 * | 6/2002 | Nagai | 439/701 |
| 6,409,551 | B1 * | 6/2002 | Nagai | 439/701 |
| 6,416,700 | B1 * | 7/2002 | Hatagishi et al. | 264/242 |
| 6,443,767 | B1 * | 9/2002 | Nagai | 439/596 |
| 6,461,201 | B1 * | 10/2002 | Maeda et al. | 439/701 |
| 6,482,035 | B2 * | 11/2002 | Okabe et al. | 439/596 |
| 6,485,333 | B1 * | 11/2002 | Shinchi | 439/587 |
| 6,494,750 | B2 * | 12/2002 | Morita et al. | 439/752 |
| 6,500,031 | B2 * | 12/2002 | Morita et al. | 439/752 |
| 6,561,837 | B1 * | 5/2003 | Ishida | 439/397 |
| 6,579,129 | B2 * | 6/2003 | Sato | 439/724 |
| 6,589,082 | B2 * | 7/2003 | Harasawa et al. | 439/752 |
| 6,645,003 | B2 * | 11/2003 | Yoshida et al. | 439/507 |
| 6,688,921 | B2 * | 2/2004 | Borgstrom et al. | 439/798 |
| 6,773,309 | B1 * | 8/2004 | Shuey | 439/701 |
| 6,893,292 | B2 * | 5/2005 | Yamamoto et al. | 439/595 |
| 6,921,289 | B2 * | 7/2005 | Takahashi et al. | 439/507 |
| 7,004,791 | B2 * | 2/2006 | Mumper et al. | 439/595 |
| 7,118,427 | B2 * | 10/2006 | Zahnen et al. | 439/798 |
| 7,134,190 | B2 * | 11/2006 | Bungo et al. | 29/753 |
| 7,134,921 | B2 * | 11/2006 | Siracki et al. | 439/798 |
| 7,297,032 | B2 * | 11/2007 | Kobayashi et al. | 439/701 |
| 7,416,445 | B1 * | 8/2008 | Brown | 439/596 |
| 7,572,154 | B2 * | 8/2009 | Ichio et al. | 439/701 |
| 7,695,315 | B2 * | 4/2010 | Hitchcock et al. | 439/541.5 |
| 7,841,913 | B2 * | 11/2010 | Hitchcock et al. | 439/752 |
| 8,608,518 | B2 * | 12/2013 | Wu | 439/812 |
| 8,727,818 | B2 * | 5/2014 | Kossak | 439/798 |
| 8,747,168 | B2 * | 6/2014 | Kida | 439/701 |
| 8,859,918 | B2 * | 10/2014 | Sisley et al. | 200/293 |
| 8,915,758 | B2 * | 12/2014 | Shishikura et al. | 439/701 |
| 2001/0022233 | A1 * | 9/2001 | Takada et al. | 174/72 A |
| 2001/0044240 | A1 * | 11/2001 | Sato et al. | 439/701 |
| 2003/0100228 | A1 * | 5/2003 | Bungo et al. | 439/701 |
| 2004/0253880 | A1 * | 12/2004 | Correll et al. | 439/752 |
| 2005/0118883 | A1 * | 6/2005 | Kim | 439/701 |
| 2006/0110986 | A1 * | 5/2006 | King et al. | 439/709 |
| 2006/0141871 | A1 * | 6/2006 | Sakamoto | 439/701 |
| 2008/0119084 | A1 * | 5/2008 | Hitchcock et al. | 439/541.5 |
| 2009/0075526 | A1 * | 3/2009 | King et al. | 439/717 |
| 2010/0136842 | A1 * | 6/2010 | Sakamoto et al. | 439/639 |
| 2013/0183842 | A1 * | 7/2013 | Shishikura et al. | 439/147 |
| 2014/0370731 | A1 * | 12/2014 | Meier et al. | 439/136 |

FOREIGN PATENT DOCUMENTS

| | | |
|---|---|---|
| DE | 19707120 | 6/1998 |
| DE | 29812500 | 9/1998 |
| FR | 2787933 | 6/2000 |

* cited by examiner

ELECTRIC COUPLING ELEMENT

The invention relates to an electric coupling element adapted to be disposed in a plug-in connector housing, preferably in a modular plug-in connector housing, consisting of an electrically insulating base body, wherein the base body includes contact cavities with electric contact elements provided therein, wherein the contact elements are preferably formed as socket or pin contacts, wherein the contact elements have a contact side that is at the front in the plug-in direction and a cable connection side that is at the rear in the plug-in direction, wherein the cable connection side is provided with connection means for fixing an electric conductor to the cable connection side of the contact element, and wherein the base body has openings that allow access to the connection means.

Such an electric coupling element is needed in order to reversibly connect electrically conductive braids, wires and cables to each other. An advantage of the mounting in a modular plug-in connector housing is that there is great flexibility in the compilation of the individual coupling elements of a plug-in connector. As a result, a plug-in connector can accommodate different conductor cross sections as well as different kinds of signal conductors. Thus, for example, electric conductors with optical conductors and pneumatic conductors can be combined as desired in a plug-in connector.

PRIOR ART

Such plug-in connectors with a modular design are already known from many prior art documents. For example, DE 34 42 056 A1, DE 298 12 500 U1, DE 197 07 120 C1 and DE 43 11 781 C1 are known in this respect. All the plug-in connectors that are already known have a reception frame that is provided for receiving individual coupling elements, so-called modules, of different kinds.

The individual electric coupling elements are usually of a compact design and include a plurality of electric contacts, By providing the coupling elements with a compact and unitary size, they can be arranged in any desired order in a plug-in connector housing.

What is of disadvantage in all of the plug-in connectors known from the prior art is that due to the compact unitary size of the coupling elements, the types of electric contact elements that can be arranged therein is greatly limited.

Thus, most electric coupling elements have contact elements that are crimped onto the conductors to be connected. These are inserted into the coupling elements in the plug-in direction, where they are locked and can be removed only by means of a special tool. As an alternative, contact elements with so-called axial screw connections are known from the prior art.

The use of contact elements with a screw connection, for the assembly and disassembly of which merely a standard screwdriver instead of a special tool is necessary, is not possible. Since the contact elements are usually screwed in through openings on the side of the coupling elements, the clearances and creepage paths between the screw connection and the nearest coupling element or the receiving frame are too small as a result of the exposed screw connections and the compact design of the coupling elements.

Excessively small clearances and creepage paths can lead to a distortion of signals or even to short circuits between various contact elements or between contact elements and the receiving frame.

A further problem with exposed screw connections on coupling elements is contact safety, which is lacking. It is easily possible for a person handling plug-in coupling elements connected to a load to touch the exposed screw connections.

OBJECT OF THE INVENTION

The invention is therefore based on the object of developing a coupling element in such a way that it can be used with screw contacts, without any other special tool being required for mounting, whilst at the same time the risk of short circuits is reduced.

This object is achieved by means of the fact that the electric element includes an electrically insulating cover plate, which cover plate is provided on the base body in front of the openings.

Advantageous embodiments of the invention are indicated in the dependent claims.

The invention relates to an electric coupling element provided for being disposed in a plug-in connector housing either alone or together with a plurality of other coupling elements. For the reception in the plug-in connector housing, a receiving frame is provided in the plug-in connector housing, which holds the coupling elements and by means of which the coupling elements can be fixed to the plug-in connector housing.

The rectangular base body of the coupling element is made from an electrically insulating material and has one or more reception cavities for electric contact elements, which continuously run along the plug-in direction. The contact elements formed as pin or socket contacts are provided in the coupling element in such a way that its contact side that is provided for electric contacting is located in the plug-in region of the coupling element that is at the front in the plug-in direction.

The coupling element has a connection region that faces away from the plug-in region and is at the rear in the plug-in direction. The connection region receives the rear part of the electric contact elements, the cable connection side. Any electric conductors to be connected are inserted into the coupling element in the connection region and are mechanically fixed in the cable connection side of the electric contact element.

The coupling element expediently includes latching means for fixing the coupling element in the mounting frame of the plug-in connector housing. The latching means are on the two narrow longitudinal sides of the rectangular coupling element. As a result, a plurality of coupling elements arranged end to end and disposed in the mounting frame lie next to each other with their wide longitudinal sides, On one of the two wide longitudinal sides, the coupling element includes a number of openings that is identical with the number of reception cavities in the base body. The openings extend from the outside of the coupling element up into the respective reception cavity that is associated with the openings.

The openings are provided for receiving connection means, by means of which the electric conductors to be connected are fastened to the contact element. The connection means is preferably formed as a screw that is screwed into the cable connection side of the contact element and fixes in this way the electric conductor.

According to the invention, a cover plate is also provided on the wide longitudinal side, which also includes the openings for the connection means. The cover plate is an electrically non-conducting, planar element which partially covers one of the wider longitudinal sides of the coupling element.

It is expedient if the cover plate is attached to be movable so that it can carry out a linear movement in and opposite to the plug-in direction. An end position of the cover plate, which is at the front in the plug-in direction, forms an open position, and an end position, which is at the rear in the plug-in direction, forms a closed position. The cover plate comprises a number of breakthroughs that is identical to the number of openings in the base body.

The diameter of the breakthroughs corresponds to that of the openings in the base body and their position, in the open position of the cover plate, coincides with that of the openings in the base body. If the cover plate is moved into the closed position, the cover plate covers the openings in the base body and it is not possible to access the connection means provided in the openings.

The cover plate is formed in the plug-in direction in such a way that in the fully plugged-in condition of the coupling element, it comes in frontal contact in the plug-in direction with the cover plate of a counter-coupling element. In this fully plugged-in condition, both cover plates, that of the coupling element and that of the counter-coupling element, are in a closed position, so that it is not possible to access the connection means.

The purpose of this dimensioning of the cover plates according to the invention is that the cover plates of two coupling elements to be mated will always push each other into the closed position, provided the cover plates are not in the closed position during the plugging together of the coupling elements.

In a preferred embodiment, the cover plate has one or more latching means on the side that faces the base body. These latching means engage in the openings of the base body in the closed position. In this way, any inadvertent displacement of the cover plate into the open position is avoided.

An advantageous embodiment of the coupling element provides for having further recesses in front of the openings in the plug-in direction for the connection means in the base body. The recesses are arranged in such a way that the latching means of the cover plate engage in the recesses in the open position and secure the cover plate in the open position against inadvertent closing.

In an expedient embodiment, the cover plate has ribs on the side that faces the base body, which ribs engage in grooves in the base body of the coupling element. These are used, in the closed position, for increasing the electric creepage paths between the individual contact elements of the coupling element.

EMBODIMENT EXAMPLE

An embodiment example of the invention is shown in the drawing and will be explained in more detail below. In the drawings.

Figure 1:
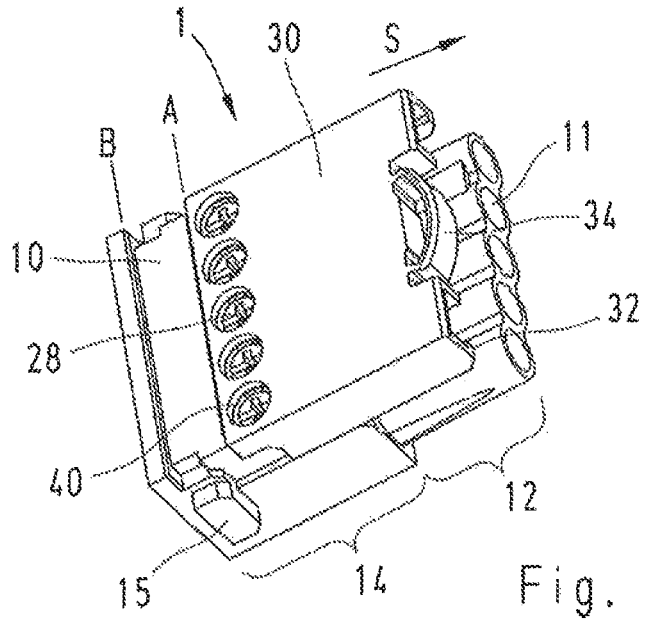
FIG. 1 shows a first embodiment of an electric coupling element with socket contact elements.

In FIG. 1, a three-dimensional view of a first embodiment of an electric coupling element 1 is shown with socket contact elements. The electric coupling element 1 consists of a base body 10 that is made from an electrically non-conductive material. The base body 10 is formed from a plug-in region 12 that is at the front in the plug-in direction S and from a connection region 14 that is at the rear in the plug-in direction S.

In the plug-in direction 5, a plurality—here five—of contact cavities 11 extends through the base body 10, which contact cavities are used for receiving contact elements 20. The plug-in region 12 is provided for coupling with a second coupling element 1, whereas the contact region 14 is used for receiving electric conductors 3 to be connected.

Each of the narrow longitudinal sides of the base body 10 has one latching means 15 moulded thereto, which is used for receiving and latching the coupling element 1 in a plug-in connector housing. The shape and dimensions of the coupling elements 1 as well as the latching means 15 are standardised, so that is possible to combine and replace various coupling elements 1 in a plug-in connector.

On the top side of the coupling element 1 as shown in FIG. 1, a cover plate 30 is shown. According to the invention, the cover plate 30 is provided for covering the connection means 28. The connection means 28 are used for connecting the electric conductors 3 to the contact elements 20 which are received in the coupling element 1. Preferably, the connection means 28 are formed as screws.

The cover plate 30 is here shown in a mounting position A which is at the front in the plug-in direction S. In this mounting position A, the connection means 28 can be accessed so as to operate the latter. Access to the connection means 28 is enabled by the breakthroughs 40 which are inserted into the cover plate 30 and which in the mounting position A are located above the connection means 28.

Figure 2:
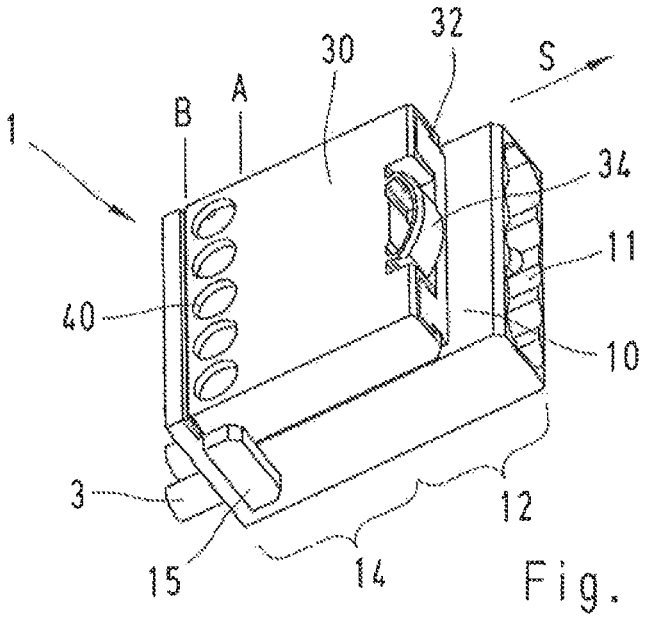
FIG. 2 shows a second embodiment of an electric coupling element with pin contact elements.

A second embodiment with in contact elements is also shown in a three-dimensional view in FIG. 2. This embodiment differs from the embodiment of FIG. 1 by an adapted plug-in region 12, in order to correspondingly receive contact elements 20 which are formed as pin contact elements.

In FIG. 2, the cover plate 30 is shown in a working position B which is at the rear in the plug-in direction S. In this position, which is linearly displaced opposite to the plug-in direction S, it is not possible to access the connection means 28. The cover plate 30, which is also made from an electrically non-conductive material, covers the connection means 28, so that neither a mechanical nor an electrical access thereto is possible.

Figure 3:
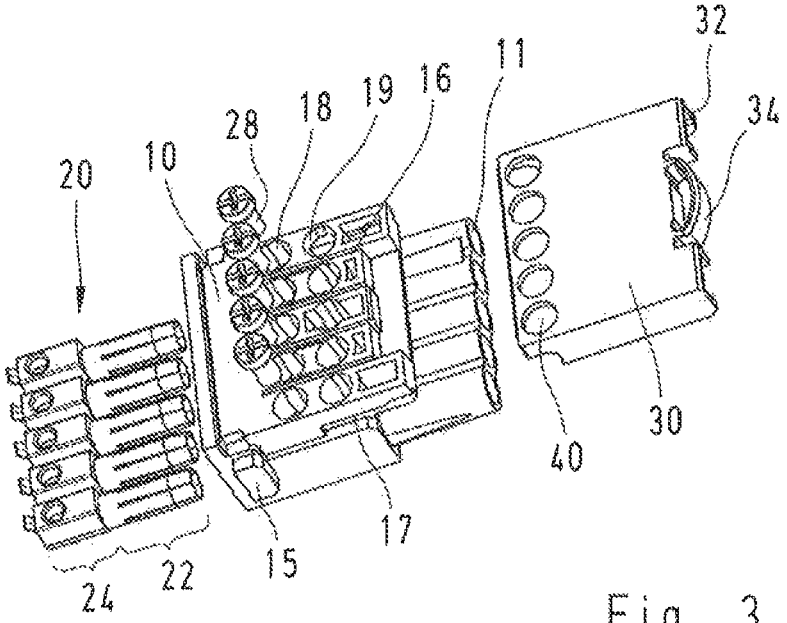
FIG. 3 shows an exploded view of a first embodiment of an electric coupling element.

A first embodiment of a coupling element 1 is shown in FIG. 3 in a three-dimensional exploded view. In the left-hand region, the five contact elements 20 are shown, which are here formed as socket contact elements. The contact elements 20 have a cable connection side 24 which is at the rear in the plug-in direction S, which is designed for receiving an electric conductor 3 and which both mechanically and electrically contacts said electrical conductor 3. For a mechanical contacting of the conductor 3, the connection means 28—here screw—are screwed into the cable connection side 24 and clamp the inserted conductor 3.

The region of the contact elements 20 which is at the front in the plug-in direction S is formed by the contact side. These contact elements 20, which are here formed as socket contacts, are used for contacting the contact elements 20' of a counter-coupling element 1'.

In the central part of FIG. 3, the base body 10 of the coupling element 1 is shown. The plug-in region 12 of the coupling element 1 is provided for receiving the contact side 22 of the contact elements 20, and the connection region 14 is provided for receiving the cable connection side 24 of the contact elements 20.

On the upper, wide longitudinal side of the base body 10, openings 18—here five—are provided in a corresponding number of contact elements 20. The openings 18 reach from the top face of the base body 10 into the contact cavities 11, in which the contact elements 20 are provided.

The openings 18 are provided for receiving the connection means 28 and to allow access thereto. The connection means 28 are screwed in through the openings 18 in the cable connection sides 24 of the contact elements 20.

On its narrow longitudinal sides, the base body 10 preferably includes guiding grooves 17 which are used for guiding and anchoring the cover plate 30. The cover plate 30 is guided by means of guiding strips 37 into the guiding grooves 17 and can in this way carry out a linear movement in the plug-in direction S between the mounting position A and the working position B.

In the plug-in direction S next to the openings 18, additional recesses 19 are provided, which are used for latching the cover plate 30 in the mounting position A. To this end latching means 38, which are located on the side of the cover plate 30 that faces the base body 10, latch into the recesses 19. The shape of the recesses 19 corresponds to that of the openings 18, as a result of which in the working position B, the cover plate 30 can latch in the openings 18 with the latching means 39.

The latching means 38 are formed as flat elevations on the cover plate 30. These fit, in terms of their shape and size, exactly into the openings 18 and the recesses 19 and retain in this way the cover plate 30 in the mounting position A or in the working position B.

Figure 4:
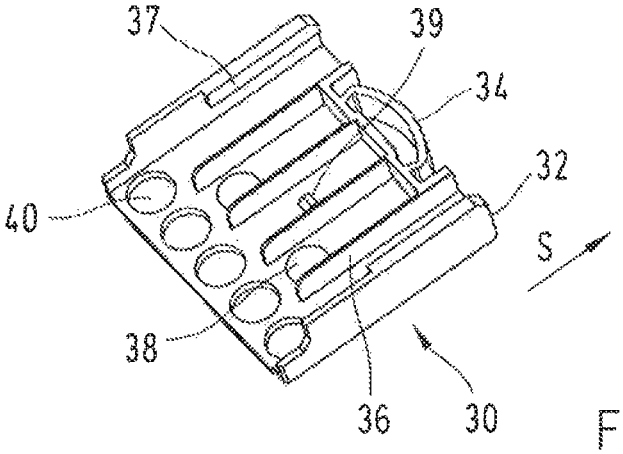
FIG. 4 shows a cover plate.

In the right-hand region of FIG. 3, a cover plate 30 according to the invention is shown which is also shown in FIG. 4 from the side facing the base body 10. The cover plate 30 is generally U-shaped and is made from an electrically non-conductive material. The U-shape is intended to ensure that the cover plate 30 at least partially encompasses the base body 10. The guiding strips 37, which are moulded onto the inside of the cover plate 30, engage in the guiding grooves 17 on the base body 10 and retain in this way the cover plate 30 on the base body 10. The guiding grooves 17 allow a linear movement of the cover plate 30 directed in the plug-in direction S from the mounting position A to the working position B.

In the embodiment shown, the cover plate 30 has a spring element 34 that is attached to the cover plate 30 in the region 32 that is at the front in the plug-in direction S. The spring element 34 exerts a force on the cover plate 30, when the coupling element 1 is contacted by a second coupling element 1, and forces the cover plate 30 into the working position B.

According to the invention, ribs 36 are moulded to the side of the cover plate 30 that faces the base body 10. The ribs 36 are plunged into grooves 16 on the base body 10. As a result of the ribs 36 being plunged into the grooves 16, the electric creepage paths between the individual contact elements 20 in the base body 10 are enlarged.

In the embodiment shown, the cover plate 30 has an additional stop 39 that is supposed to prevent, during the displacement of the cover plate 30 into the mounting position A, an inadvertent removal of the cover plate 30 from the base body 10.

Figure 5:
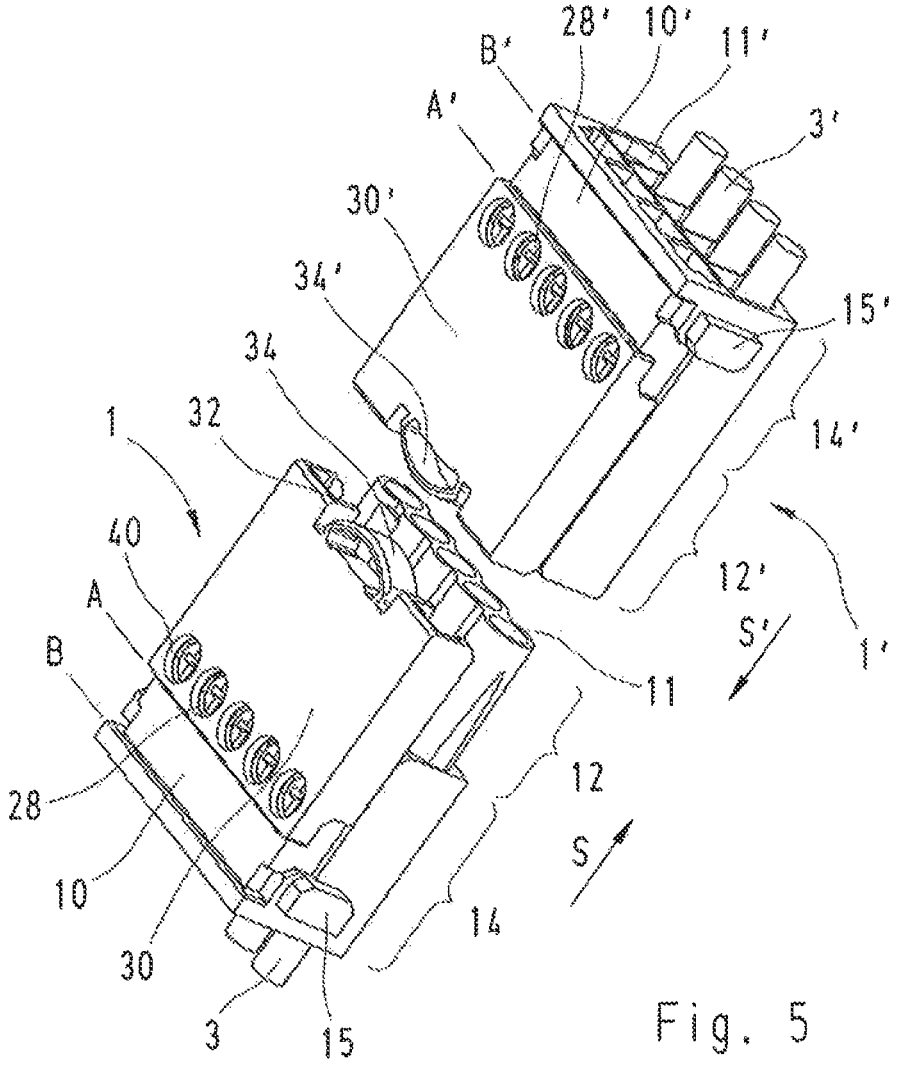
FIG. 5 shows a first and second embodiment of two electric coupling elements in the non-plugged condition.
Figure 6:
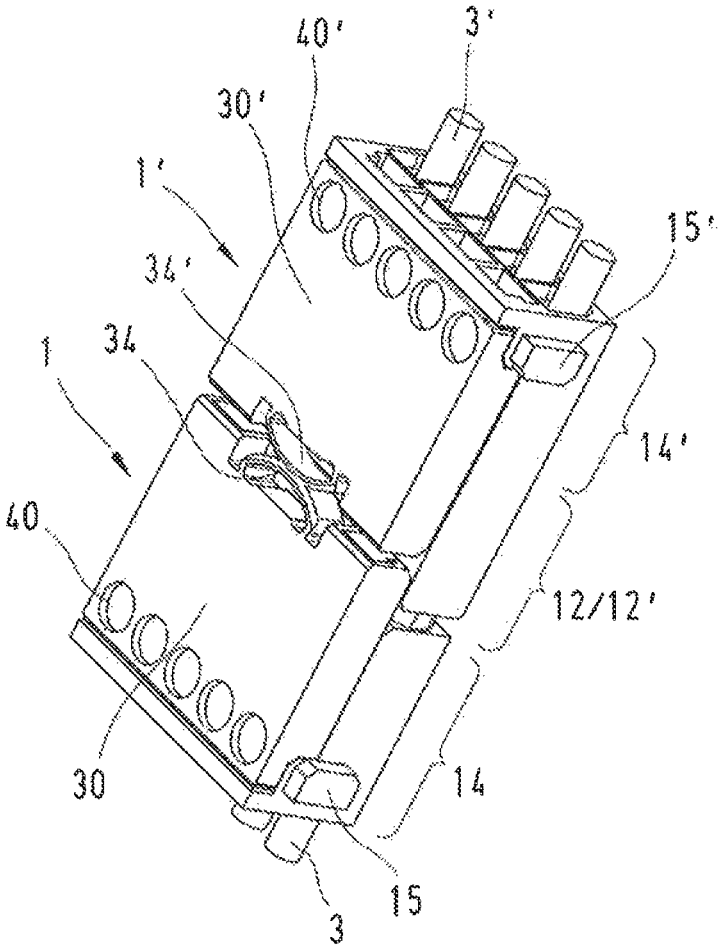
FIG. 6 shows a first and second embodiment of two electric coupling elements in the plugged condition.

FIG. 5 and FIG. 6 each show a pair of coupling elements 1, 1' in a non-plugged condition and in a plugged condition, respectively. What can be seen are the oppositely shown coupling elements 1, 1', wherein the coupling element 1 is provided with socket contacts and the coupling element 1' is provided with pin contacts. In the connection regions 14, 14' of the base bodies 10, 10', which are each at the rear in the plug-in directions S, S', electric conductors 3, 3' are shown which are electrically connected in the coupling elements 1, 1' with the contact elements 20, 20' which cannot be seen here. In FIG. 6, the plug-in regions 12, 12' are mated together in the plugged-in condition.

According to the invention, FIG. 5 shows the cover plates 30, 30' in the mounted position A. In this position, they allow access to the connection means 28, 28', by means of which the electric conductors 3, 3' are mechanically and electrically fixed in the contact elements 20, 20'.

In the plugged-in condition, as shown in FIG. 6, the cover plates 30, 30 are in the working position B and cover in this way the access to the connection means 28, 28'. As a result of the plugging in of the coupling elements 1, 1', the cover plates 30, 30' have displaced each other into the working position B. The spring elements 34, 34' push against each other and exert in this way a force onto the cover plates 30, 30', which retain the covers 30, 30' in the working position B.

Electric Coupling Element

List of Reference Numerals

1 Coupling element
3 Electric conductor
10 Base body
11 Contact cavity
12 Plug-in region
14 Connection region
15 Latching means
16 Groove
17 Guiding groove
18 Opening
19 Recess
20 Contact element
22 Contact side
24 Cable connection side
28 Connection means
30 Cover plate
32 Front region
34 Spring element
36 Rib
37 Guiding strip
38 Latching means
39 Stop
40 Breakthrough
A Mounting position
B Working position
S Plug-in direction

The invention claimed is:

1. An electric coupling element (1) adapted to be disposed in a plug-in connector housing, preferably in a modular plug-in connector housing, comprising, an electrically insulating base body (10), wherein the base body (10) includes contact cavities (11) with electric contact elements (20) provided therein, wherein said contact elements (20) are preferably formed as socket or pin contacts, wherein said contact elements (20) have a contact side (22) that is at the front in the plug-in direction (S) and a cable connection side (24) that is at the rear in the plug-in direction (S), wherein the cable connection side (24) has a connector screw (28) for fastening an electric conductor (3) to the cable connection side (24) of the contact element (20), and wherein said base body (10) has openings (18) which allow access to the connector screw (28), wherein said electric coupling element (1) further comprises an electrically insulating cover plate (30), said cover plate (30) provided on the base body (10) to overlie the openings (18) and connector screw (28), characterised in that said cover plate (30) is arranged on said base body so as to be linearly displaceable in and opposite to the plug-in direction (S) to open and close the openings (18) without contact with the electric conductor (3), the contact element (20), or the connector screw (28).

2. The electric coupling element (1) as claimed in claim 1, characterised in that the cover plate (30) allows access to the openings (18) in a first open position (A), which is at the front in the plug-in direction (S), and covers the openings (18) in a second closed position (B), which is at the rear in the plug-in direction (S).

3. An electric coupling element (1) adapted to be disposed in a plug-in connector housing, preferably in a modular plug-in connector housing, comprising, an electrically insulating base body (10), wherein the base body (10) includes contact cavities (11) with electric contact elements (20) provided therein, wherein said contact elements (20) are preferably formed as socket or pin contacts, wherein said contact elements (20) have a contact side (22) that is at the front in the plug-in direction (S) and a cable connection side (24) that is at the rear in the plug-in direction (S), wherein the cable connection side (24) has a connector (28) for fastening an electric conductor (3) to the cable connection side (24) of the contact element (20), and wherein said base body (10) has openings (18) which allow access to the connector (28), wherein said electric coupling element (1) further comprises an electrically insulating cover plate (30), and said cover plate (30) is provided on the base body (10) in front of the openings (18), said cover plate (30) is arranged on said base body so as to be linearly displaceable in and opposite to the plug-in direction (S) to allow access to the openings (18) in a first open position (A), which is at the front in the plug-in direction (S), and covers the openings (18) in a second closed position (B), which is at the rear in the plug-in direction (S), wherein said electric coupling element is matable with another electric coupling element by contact between the fronts of each electric coupling element in the plug-in direction with the cover plates (30, 30') of the two completely mated coupling elements (1) each located in their rear, closed position (B, B').

4. The electric coupling element (1) as claimed in claim 3, characterised in that a spring element (34) is provided in a region (32) of the cover plate (30) that is at the front in the plug-in direction (S), which spring element, in the fully mated condition of the electric coupling element (1), generates a force with said mated electric coupling element (1'), which forces the cover plates (30, 30') each into the rear closed position (B, B').

5. The electric coupling element (1) as claimed in claim 3, characterised in that the cover plate (30) has one or more ribs (36) on the side that faces the base body (10), which ribs engage, in the rear, closed position (B), in grooves (16) in the base body (10), and wherein the grooves (16) extend along the plug-in direction (S) between the openings (18).

6. The electric coupling element (1) as claimed in claim 3, characterised in that the cover plate (30) has at least one latch (38) on the side facing the base body (10), wherein the latch (38) engages in one of the openings (18) in the rear, closed position (B).

7. The electric coupling element (1) as claimed in claim 3, characterised in that said connector (28) is a screw.

8. An electric coupling element (1) adapted to be disposed in a plug-in connector housing, preferably in a modular plug-in connector housing, comprising, an electrically insulating base body (10), wherein the base body (10) includes contact cavities (11) with electric contact elements (20) provided therein, wherein said contact elements (20) are preferably formed as socket or pin contacts, wherein said contact elements (20) have a contact side (22) that is at the front in the plug-in direction (S) and a cable connection side (24) that is at the rear in the plug-in direction (S), wherein the cable connection side (24) has a connector (28) for fastening an electric conductor (3) to the cable connection side (24) of the contact element (20), and wherein said base body (10) has openings (18) which allow access to the connector (28), wherein said electric coupling element (1) further comprises an electrically insulating cover plate (30), and said cover plate (30) is provided on the base body (10) in front of the openings (18), said cover plate (30) is arranged on said base body so as to be linearly displaceable in and opposite to the plug-in direction (S) to open and close the openings (18) without contact with the electric conductor (3), the contact element (20), or the connector (28), and to allow access to the openings (18) in a first open position (A), which is at the front in the plug-in direction (S), and to cover the openings (18) in a second closed position (B), which is at the rear in the plug-in direction (S), wherein said cover plate (30) has a stop (39) on the side facing the base body (10), wherein the stop (39) hooks into the base body (10) in the open position (A) and avoids a complete removal of the cover plate (30) from the base body (10).

* * * * *